US006026826A

United States Patent [19]

Hall et al.

[11] Patent Number: 6,026,826

[45] Date of Patent: Feb. 22, 2000

[54] DEVICE FOR PERMANENTLY CURLING HAIR

[76] Inventors: David Hall; Brenda Hall, both of 7810 Florida Blvd., Denham Springs, La. 70726

[21] Appl. No.: 09/245,688

[22] Filed: Feb. 6, 1999

[51] Int. Cl.[7] ..... A45D 6/16

[52] U.S. Cl. ..... 132/252; 132/222; 132/268; 132/253

[58] Field of Search ..... 132/207, 250, 132/252, 253, 254, 260, 262, 267, 268, 222, 255, 249

[56] References Cited

U.S. PATENT DOCUMENTS

| | | | |
|---|---|---|---|
| 2,429,176 | 10/1947 | Watson | 132/252 |
| 2,938,523 | 5/1960 | Solomon | 132/249 |
| 3,008,475 | 11/1961 | Solomon | 132/255 |
| 3,067,755 | 12/1962 | Hoffmann et al. | 132/255 |
| 3,367,345 | 2/1968 | Riley | 132/207 |
| 3,960,156 | 6/1976 | Thompson | 132/222 |
| 4,603,706 | 8/1986 | Caruso | 132/262 |
| 5,474,096 | 12/1995 | Dohmen | 132/262 |
| 5,819,760 | 10/1998 | Wimer | 132/207 |

FOREIGN PATENT DOCUMENTS

| | | | |
|---|---|---|---|
| 552593 | 12/1959 | Belgium | 132/260 |
| 461553 | 12/1991 | European Pat. Off. | 132/249 |
| 3616076 | 11/1987 | Germany | 132/207 |

*Primary Examiner*—Todd E. Manahan
*Attorney, Agent, or Firm*—Keaty Professional Law Corporation

[57] ABSTRACT

A device for permanently curling hair has a hair rod, a cap, and an optional elastic band for attaching the cap to the hair rod. The hair rod is formed as a cylindrical hollow body. A first and second end plates are positioned on respective ends of the body. A plurality of outwardly extending projections formed on an outer surface of the body between the first and the second end plates facilitate retaining of hair on the rod during the rolling process. The body has a pair of diametrically opposite elongated slots that help retain pieces of perm paper on the hair and the rod, and a plurality of openings extending through the body that facilitate free water and perming solution flow through the hair rod. The cap has a lengthwise slit, and is sufficiently resilient to permit the lengthwise slit to be selectively widened by hands to snap over the body to thereby closely encircle the body with the mesh cap.

4 Claims, 3 Drawing Sheets

DEVICE FOR PERMANENTLY CURLING HAIR

FIELD OF THE INVENTION

The present invention relates to hair styling accessories, and more particularly to hair rod devices for permanently curling hair.

BACKGROUND OF THE INVENTION

A number of methods have been devised for curling hair. Some of them involve permanent waving of hair using a special chemical solution, the so-called peering solution, for wetting hair and imparting a permanent wave to the hair. This method employs a plurality of peering rods. In this method, a particular type of paper, known as perm paper, is folded around the ends of separated wet strands of hair. The perm paper and strands of hair are then rolled onto a perming rod. The perm rod, hair, and perm paper are secured, such as by a rubber band, so that the hair is held in a rolled up configuration.

Once the strands of hair have been prepared, the perming solution is applied to the hair. The perming solution is allowed to remain on the hair for a designated amount of time in order to set the hair in the desired wave. The hair is then rinsed with water to remove the perming solution, leaving curls in the hair. A neutralizing solution is then applied to the rolled hair strands. After approximately five minutes, the hair is thoroughly rinsed with water, and the perm rods and paper are then removed.

A number of problems are frequently encountered in curling hair using the above method, including: (1) difficulty in securing the hair and perm paper on the rod; (2) difficulty in keeping hair wrapped on rods while thoroughly rinsing the curls with water prior to removing the rods; (3) loss of time and quality of perm results because hair becomes unrolled; and (4) loss of perming solution, which drips off of the hair while applying perming solutions. Accordingly, there is a need for an invention that overcomes the aforementioned problems.

OBJECTS AND SUMMARY OF THE INVENTION

It is an object of the invention to provide a device for permanently curling hair that facilitates securing rolled hair on the rod.

It is another object of the invention to provide a device for curling hair that facilitates rinsing of hair curled on the rod.

It is another object of the invention to provide a device for curling hair that minimizes the loss of perming solution.

It is another object of the invention to provide a device for curling hair that facilitates matching a cap with a rod.

These and other objects and advantages of the invention shall become apparent from the following general and preferred description of the invention.

Accordingly, a device for curling hair is provided comprising a hair rod, a cap, and an optional means for attaching the cap to the hair rod. The hair rod comprises a generally cylindrical hollow body. A first end plate is positioned on a first end of the body, and a second end plate is positioned on a second end of the body. One or both of the end plates can be provided with an opening therethrough.

A plurality of outwardly extending projections are formed on an outer surface of the body between the first and the second end plates to help in frictional contact of hair with the curling rod. The body has a pair of diametrically opposite elongated slots for securing perm paper to the rod. The body is also preferably provided with a plurality of openings extending through the body to facilitate free water and perming solution flow through the hair rod. The plurality of openings are preferably arranged in a pair of diametrically opposed longitudinal rows. In an alternative embodiment, the body does not have an elongated slot, and instead is provided with a plurality of smaller openings that serve to facilitate the free flow of water and perming solution through the rod.

The mesh cap is sized to closely encircle at least a portion of the hair rod between the first and second end plates. The cap has a lengthwise slit, and is sufficiently flexible and resilient to permit the lengthwise slit to be selectively manually widened to snap over the body to thereby closely encircle the body with the mesh cap.

The attachment means is preferably an elastic band. In a preferred embodiment, the second end plate preferably carries a hollow dome portion having an aperture therethrough. The elastic band has an enlarged tip on one end, and the enlarged tip is positioned on an inner side of the dome portion. The enlarged tip is larger than the aperture to prevent the band from disengaging from the hair rod.

PREFERRED EMBODIMENTS OF THE INVENTION

Figure 1:
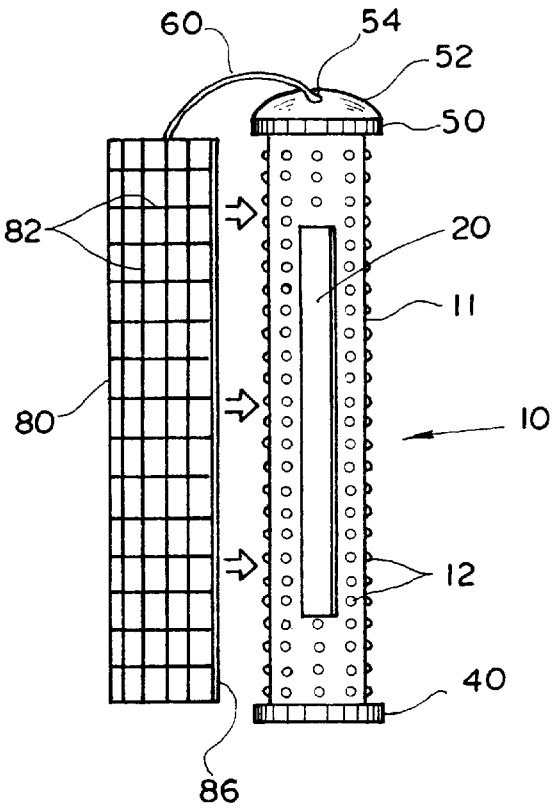
FIG. 1 is a side view of the first embodiment of the invention showing the hair rod and mesh cap in a disengaged position.

As shown in FIG. 1, the device for curling hair of the invention comprises a hair rod 10 and a mesh cap 80. The hair rod 10 comprises a generally cylindrical hollow body 11. A first end plate 40 is positioned on a first end of the body 11. A second end plate 50 is positioned on a second end of the body 11. The outer surface of the body 11 located between the end plates 40, 50 serves as a rolling area for curling hair.

The first end plate 40 can provide a closed first end of the body 11. Alternatively, the first end plate 40 can be provided with an aperture therethrough communicating with the internal chamber 14 (See FIG. 4) of the body 11. Similarly to the first end plate 40, the second end plate 50 can either close the second end of the body, or be provided with an aperture therethrough communicating with the internal chamber 14. The second end plate 50 can be provided with a hollow dome portion 52 having an aperture 54 for use in attaching the hair rod 10 to the mesh cap 80, as described in further detail below. Alternatively, the second end may be provided with a groove 55 (FIGS. 6–8) for securing an attachment means therein.

A plurality of outwardly extending projections 12 are formed on an outer surface of the body 11. between the first and second end plates 40, 50. When a section of hair is rolled onto the body 11 of the rod 10, in the manner described in further detail below, the outwardly extending projections 12 hold the hair in place, thus substantially preventing the rod 10 from slipping relative to the hair during the rolling process. Once the rolling process is complete, the projections 12 assist in holding the rolled hair on the body 11 of the rod 10 until the mesh cap 80 is placed on the rod 10.

In the embodiment shown in FIG. 1, the body 11 has at least one elongated slot 20 extending in a substantially parallel relationship to a longitudinal axis of the body 11. In a preferred embodiment, the body 11 has two slots 20 formed in the body 11 and located on diametrically opposite surfaces of the body 11.

The elongated slots 20 communicate with the internal chamber 14 of the hair rod 10, and serve primarily to provide a means for anchoring perm paper 70 (FIG. 6) to the body 11 of the rod 10, as will be described in further detail below. The elongated slots 20 also facilitate the free flow of water or perming (waving) solution through the hair rod 10. As shown in the cross-sectional view of FIG. 4, the body 11 is preferably provided with a pair of elongated slots 20.

Figure 4:
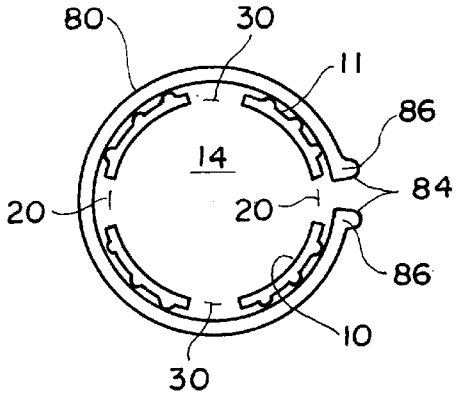
FIG. 4 is a cross-sectional view taken along lines A—A of FIG. 3 showing the diametric positioning of the slots and openings on the hair rod, and showing the mesh cap encircling the body of the hair rod.

As further shown in FIG. 4, the elongated slots 20 are preferably diametrically opposed, i.e. positioned on opposite sides of the circumference of the body 1. The elongated slots 20 can be provided with indented edges, as shown in FIG. 1 and in cross-section in FIG. 4, or with straight edges (not shown).

Figure 2:
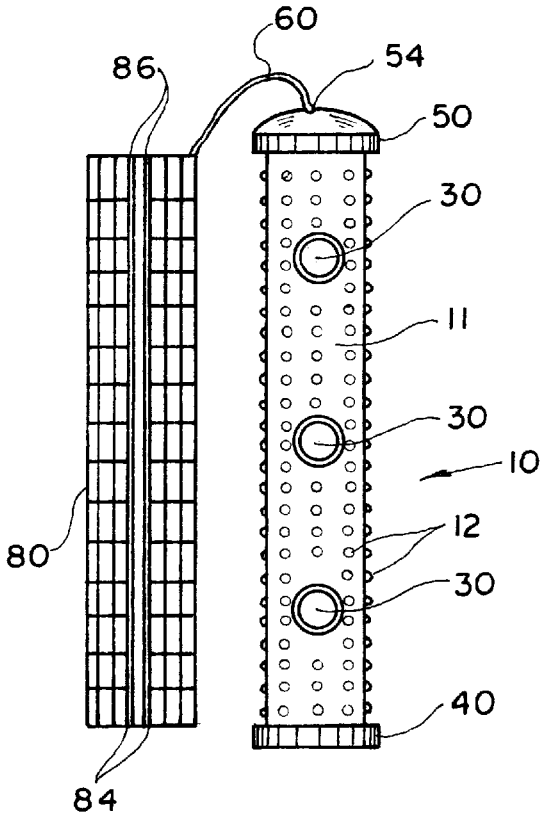
FIG. 2 is a side view of the first embodiment of the invention, rotated ninety degrees from FIG. 1.
Figure 5:
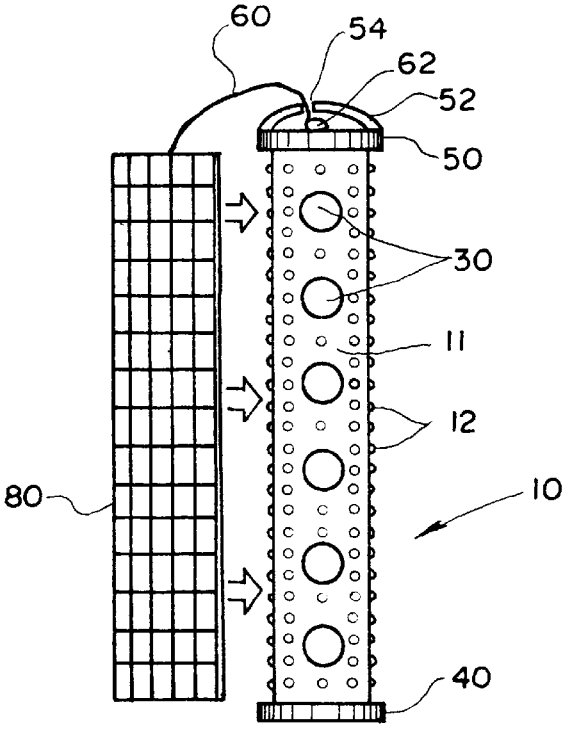
FIG. 5 is a side view of a second embodiment of the hair rod showing a cross-sectional view of the dome portion of an end plate.

As shown in FIG. 2, the body 11 of the hair rod 10 is also preferably provided with a plurality of openings 30. The openings 30 extend through the body 11, communicating with the internal chamber 14 to facilitate free water and perming solution flow through the hair rod 10, as will be described in further detail below. Like the elongated slots 20, the openings 30 can be provided with indented edges, as shown in FIG. 1 and in cross-section in FIG. 4, or with straight edges as shown in FIG. 5. The plurality of openings 30 is preferably arranged in at least one longitudinal row, as shown in FIG. 2. As shown in FIG. 4, the body 11 of the hair rod 10 is preferably provided with a pair of diametrically opposed longitudinal rows of openings 30.

FIG. 5 shows a second embodiment, in which the body 11 of the hair rod 10 is provided with a plurality of smaller openings 30. In this embodiment, the smaller openings are designed to facilitate the free flow of water and perming solution through the rod 10. As shown in FIG. 5, the plurality of openings 30 are preferably arranged in at least one longitudinal row. This embodiment can alternatively be provided with at least one elongated slot 20.

As shown in FIG. 4, the mesh cap 80 is sized to closely encircle at least a portion of the hair rod 10 between the first and said second end plates 40, 50. The mesh cap 80 preferably encircles more than one-half, or even more preferably, substantially the entire outer surface of the body 11 of the rod 10. The cap 80 has a lengthwise slit 84. The lengthwise slit 84 allows the cap 80 to be selectively snapped onto and off of the rod 10 as needed during the process of curling hair. The cap 80 is sufficiently flexible and resilient to permit the lengthwise slit 84 to be selectively manually widened so as to snap the cap over the body 11 to thereby closely encircle the body 11 with the cap 80.

The edges of the lengthwise slit 84 can be provided with ribs 86 for providing strength and durability to the slit 84 and to assist a user in widening the slit 84. The mesh 82 of the cap 80 is constructed in a manner known to those of ordinary skill in the art; it can be made of such inexpensive and readily available material as plastic.

The mesh cap 80 serves to hold the hair on the body 11 of the rod 10, and also to help retain perming solution on the hair prior to rinsing. In an alternative embodiment, the mesh cap 80 can be provided with only longitudinal strips running lengthwise between the ends of the cap (not shown).

The hair rod 10 can be optionally attached to the mesh cap 80 by an attachment means 60. The attachment means 60 serves primarily as a convenience and efficiency feature. For example, a beautician will frequently place a large quantity of rods in a bag for use during the process of curling hair. In curling hair, the beautician will frequently reach into the bag to pull out a rod. Because the cap 80 and rod 11 are attached to one another by the attachment means 60, the beautician does not have to match a cap 80 with a rod 10, thus saving time in the hair curling process.

The attachment means 60 is preferably a band or strip of flexible material, such as rubber, string, plastic, wire, cable, or a combination thereof. The attachment means 60 is preferably elastic, which allows the attachment means 60 to be short in length and stretchable as needed to provide a desired range of movement. The attachment means 60 can be attached to the cap 80 and rod 10 in any manner that allows sufficient movement of the cap 80 relative to the rod 10. For example, the attachment means 60 could be welded, tied, or stapled to the cap 80 and rod 10.

A preferred means of attaching the cap 80 to the rod 10 is shown in FIG. 5, which presents a cross-sectional view of the dome portion 52 of the second end plate 50. In the embodiment of FIG. 5, the attachment means 60 is a band having an enlarged tip 62 on one end. The enlarged tip 62 is positioned on an inner side of the dome portion 52. The enlarged tip 62 is larger than the aperture 54 in order to prevent the band from disengaging from the hair rod 10.

Figure 6:
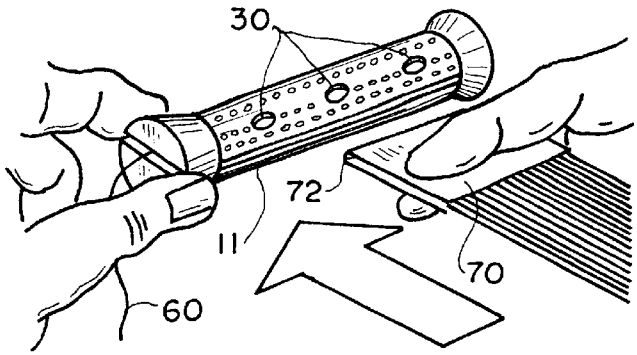
FIG. 6 illustrates a manner of positioning perm paper on the hair and retaining the perm paper on the curling rod of the present invention.
Figure 7:
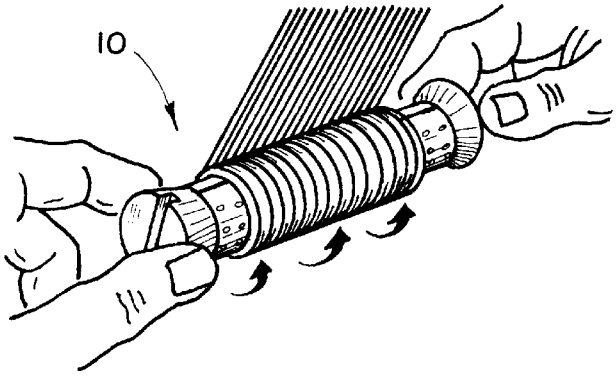
FIG. 7 illustrates the next step in the hair curling process, where a strand of hair is wrapped around the curling rod.
Figure 8:
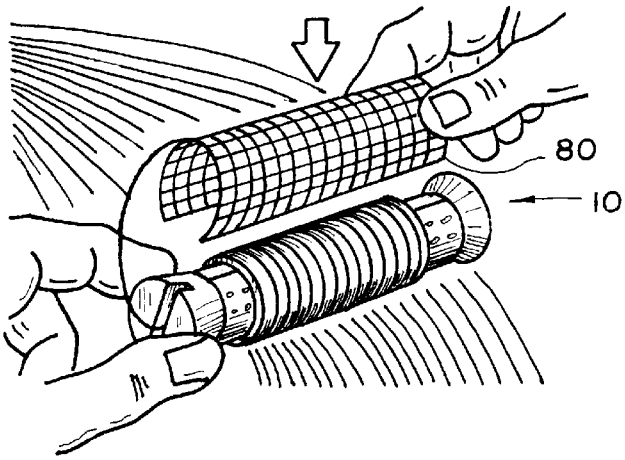
FIG. 8 illustrates another step in the hair curling process, where a mesh cap is placed over the hair and the curling rod.

An alternative means of securing the band 60 is shown in FIGS. 6–8, wherein a groove 55 is formed in the end plate of the rod 1, and one end of the band 60 is secured within the groove 55. The band 60 may be secured to the end plate by using an enlarged tip on that end of the band 60 or by other suitable means.

The hair rod body 11 can be manufactured in any convenient size, depending on the type of curl desired. For larger waves, the diameter of the body 11 can be about 1.5 inches, while smaller waves can be made with a rod having a diameter of about 0.5 inch. The end plates, being greater in diameter than the body 11, facilitate retaining of hair rolled over the body 11 and present convenient grasping flanges for use by a hair dresser. As shown in FIGS. 6–8, one or both end plates facilitate handling of the curling device.

The body 11 and the end plates with the dome portion can be made of different materials, such as plastic, rubber and the like. The main requirement, of course, is to have a flexible body that is lightweight and is capable of withstanding repeated chemical applications.

Figure 3:
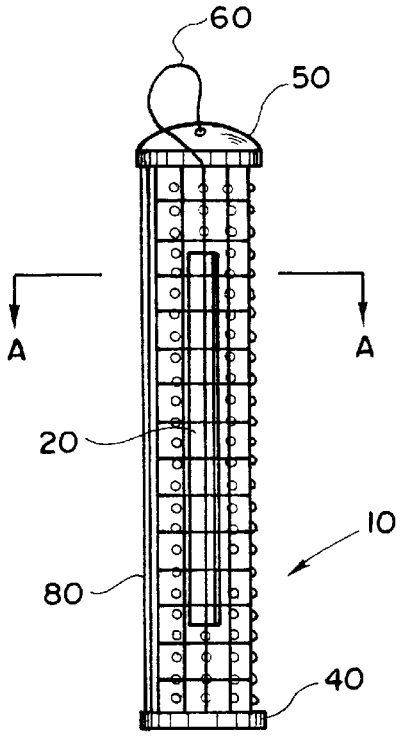
FIG. 3 is a side view of the first embodiment of the invention showing the hair rod and mesh cap in an engaged position.

In operation, the hair curling device of the invention is used by first separating a strand of hair from a body of hair and folding a piece of perm paper 70 around the end of the strand of hair. A forward edge 72 (FIG. 6) of the perm paper 70 is then placed in the elongated slot 20 of a rod 10 in order to retain the perm paper and the end of the strand of hair on the roller 10. With the perm paper and hair secured on the rod 10, the perm paper and strand of hair are then rolled onto the body 10 of the rod 11 (FIG. 7). Once the hair has been rolled onto the rod 10, the lengthwise slit 84 of the cap 80 is manually widened so as to snap the cap 80 onto the body 11, as shown most clearly in FIG. 3. Once the cap 80 is snapped in place, it encircles the perm paper, the strand of hair, and the body 11 of the rod 10.

Once the strands of hair have been prepared, the perming solution is applied to the hair in the conventional manner. The perming solution is allowed to remain on the hair for a designated amount of time in order to set the hair in the desired wave. The hair is then rinsed with water to remove the perming solution, leaving curls in the hair. A neutralizing solution is then applied to the rolled hair strands. After approximately five minutes, the hair is thoroughly rinsed with water, and the rods 10 and paper are then removed. Because the rod 10 is provided with a plurality of openings 30, water, perming, and neutralizing solution flow freely through the hair rod and the hair. The elongated slots 20 and the first or second open ends, if provided, also contribute to the free flow of water through the hair rod and the hair.

The curling rod of the present invention may be also used for a process of straightening, or relaxing hair, wherein a special chemical composition is applied to the hair in order to relax existing curls. The method of using the device of the present invention in this process is basically the same as outlined above, except a different type of chemical lotion is used.

Although the present invention has been described in terms of specific embodiments, it is anticipated that alterations and modifications thereof will no doubt become apparent to those skilled in the art. It is therefore intended that the following claims be interpreted as covering all such alterations and modifications that fall within the true spirit and scope of the invention.

We claim:

1. A device for permanently curling hair, comprising:

a hair rod comprising a generally cylindrical hollow body, a first end plate positioned on a first end of said body, a second end plate positioned on a second end of said body, said body having at least one elongated slot for receiving and retaining an edge of a piece of perm paper on said body, said elongated slot extending in a substantially parallel relationship to a longitudinal axis of said body;

a mesh cap sized to closely encircle at least a portion of said hair rod between said first and said second end plates, said cap having a lengthwise slit, said cap being sufficiently resilient to permit said lengthwise slit to be selectively widened so as to snap said cap over said body to thereby closely encircle said body with said cap; and a means for attaching said cap to said hair rod, said means for attaching said cap to said hair rod being an elastic band.

2. A device for permanently curling hair comprising:

a hair rod comprising a generally cylindrical hollow body, a first end plate positioned on a first end of said body, a second end plate positioned on a second end of said body, said second end plate being formed with an aperture, said body being provided with a plurality of outwardly extending projections formed on an outer surface of said body between said first and said second end plates, with a pair of diametrically opposed elongated slots for receiving and retaining an edge of a piece of perm paper on said body and with a plurality of openings;

a mesh cap sized to closely encircle at least a portion of said hair rod between said first and second end plates, said cap having a lengthwise slit, said cap being sufficiently resilient to permit said lengthwise slit to be selectively widened to snap over said body to thereby closely encircle said body with said mesh cap; and an elastic band securing said cap to said hair rod, said elastic band having an enlarged tip on one end, said enlarged tip being positioned in said second plate, said enlarged tip being larger than said aperture to prevent said band from disengaging from said hair rod.

3. The device of claim 2, wherein said plurality of openings provided in said body are arranged in a pair of diametrically opposed longitudinal rows.

4. The device of claim 2 wherein said first end plate has an opening therethrough.

* * * * *